United States Patent [19]

Speiser et al.

[11] 4,086,630

[45] Apr. 25, 1978

[54] COMPUTER TYPE GOLF GAME HAVING VISIBLE FAIRWAY DISPLAY

[76] Inventors: Maxmilian Richard Speiser, 245 W. 104th St., New York, N.Y. 10025; Don Eng, 50 Bayard St., New York, N.Y. 10013; Gerry Dun Sawyer, 509 W. 112th St., New York, N.Y. 10025

[21] Appl. No.: 650,126

[22] Filed: Jan. 19, 1976

Related U.S. Application Data

[63] Continuation-in-part of Ser. No. 492,751, Jul. 29, 1974, abandoned, which is a continuation-in-part of Ser. No. 383,885, Jul. 30, 1973, abandoned.

[51] Int. Cl.[2] ..... A63B 67/02; A63B 69/36; G06F 15/20

[52] U.S. Cl. ..... 364/410; 273/176 L; 273/185 B

[58] Field of Search ..... 235/151; 273/185 R, 273/185 A, 185 B, 176

[56] References Cited

U.S. PATENT DOCUMENTS

| | | | |
|---|---|---|---|
| 3,513,707 | 5/1970 | Russell et al. | 273/185 B UX |
| 3,559,996 | 2/1971 | Hopp | 273/185 B X |
| 3,563,553 | 2/1971 | Baldwin et al. | 273/185 B X |
| 3,589,732 | 6/1971 | Russell et al. | 273/185 B X |
| 3,598,976 | 8/1971 | Russell et al. | 235/151 |

*Primary Examiner*—Joseph F. Ruggiero

[57] ABSTRACT

A computer type golf game including a spot image ball simulator, and means for changing a scene display upon a screen on which said spot image ball simulator is projected in accordance with theoretical attained distance achieved with each successive play. The scene display is projected optically from a slide magazine type projector, in which certain slides are disposed in slide retaining recesses in the slide magazine having encoded information corresponding to specific data related to the fairway of an individual hole, whereby when the first slide pertaining to that hole is positioned for projection, this information is transferred to program a computer, whereby attained yardage will activate the progression of slides to projection position. Means is provided whereby slides corresponding to certain fixed increments may be eliminated, in order to keep the total number of slides displaying the entire golf course within the capacity of the slide projector magazine. Means is included for adding to the displayed indication of distance to the pin the additional distance made necessary by driving a ball laterally with respect to the principal axis of the fairway when the attained yardage has already approached a predetermined distance from the pin. Scene display pictures correspond to views seen from points in the field in the direction toward the pin, permitting a forward, side and reverse approach to the pin, where necessary. The embodiment provides not only for a visual representation of the approximate lay of the ball, but numeric displays showing information relative to how far the golfer has progressed toward the pin with each hole, and other displays indicating a lay to the left or right of the fairway as well. Means is provided for conditioning signals received from the ball intercepting net, whereby spurious signals are eliminated.

4 Claims, 20 Drawing Figures

FIG. 8
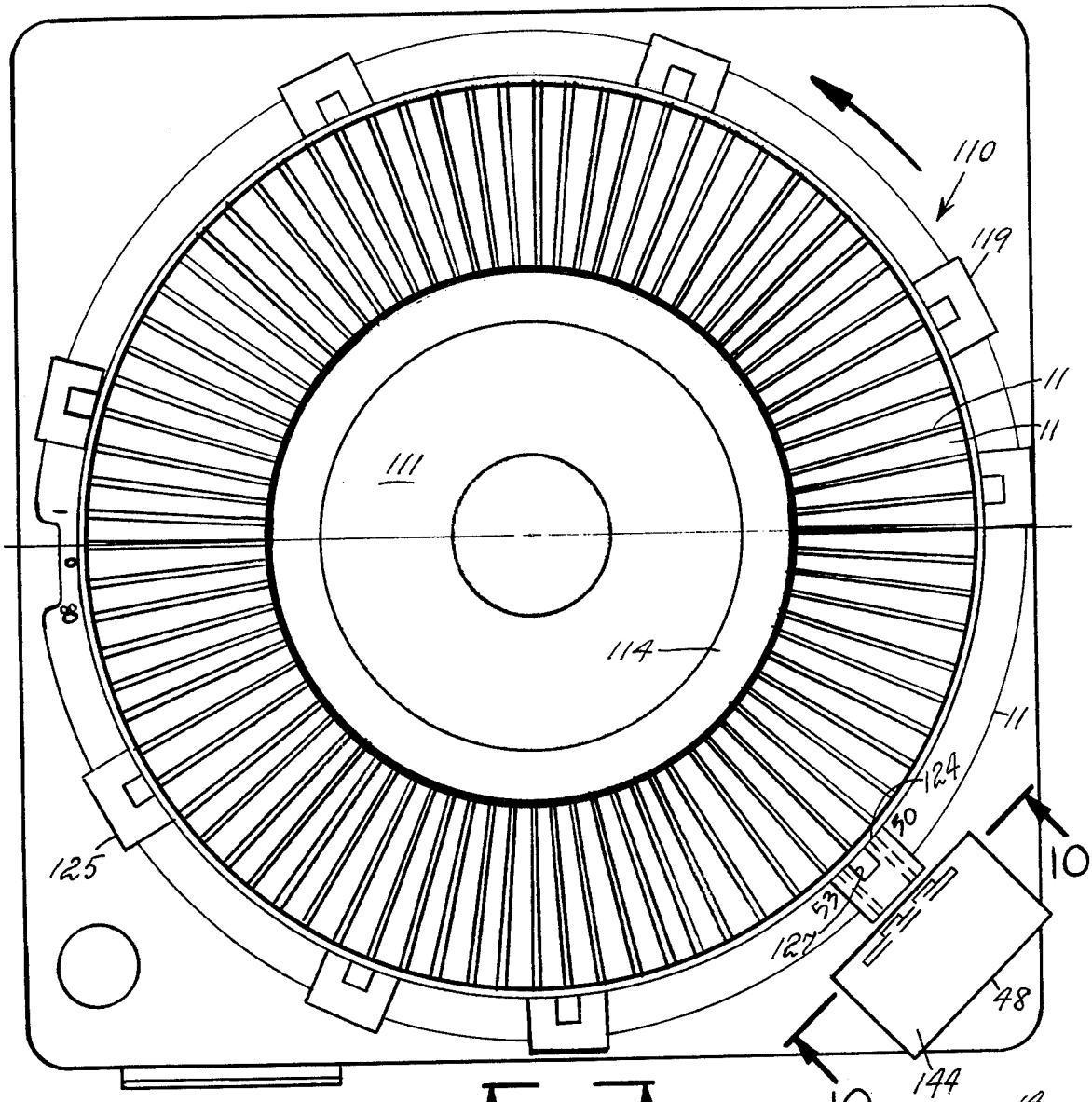
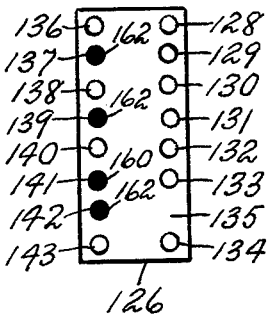
FIG. 9
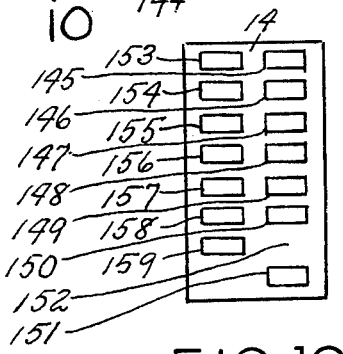
FIG. 10

| YTG RANGE | L, R | L·LL+R·RR | LL, RR | LL OOB+RR·OOB | |
|---|---|---|---|---|---|
| 0-19 | 3 | 3 | 3 | 3 | $y_5=0$ $y_8=1$ |
| 20-39 | 3 | 4 | 5 | 7 A | $y_8=1$ $y_5=0$ $<4y$ |
| 40-59 | 5 | 7 | 9 | 11 | $y_8=1$ |
| 60-79 | 7 | 10 | 12 | 15 B | $y_5=1$ $<10y$ |
| 80-99 | 9 | 12 | 16 | 20 | |
| 100-119 | 11 | 15 | 19 | 24 | $y_8=0$ $<20y$ |
| 120-139 | 12 | 18 | 23 | 28 | |
| 140-159 | 14 | 20 | 26 | 33 | YTG·A |
| 160-179 | 16 | 23 | 30 | 37 | YTG·B |
| 180-199 | 18 | 26 | 33 | 41 | |
| 200-219 | 20 | 29 | 37 | 46 | |
| 220-239 | 22 | 31 | 41 | 50 | |
| 240-259 | 24 | 34 | 44 | 55 | |
| 260-279 | 26 | 37 | 48 | 59 | |
| 280-299 | 28 | 39 | 51 | 63 | |
| 300-319 | 30 | 42 | 55 | 68 | |

FIG. 16

COMPUTER TYPE GOLF GAME HAVING VISIBLE FAIRWAY DISPLAY

RELATED APPLICATIONS

This application is a continuation in part of the copending application of Maximilian R. Speiser, Ser. No. 492,751 filed July 29, 1974, now abandoned; in turn a continuation in part of application Ser. No. 383,885 filed July 30, 1973, now abandoned.

BACKGROUND OF THE INVENTION

This invention relates generally to the field of computer type golf games in which a tee off point is lcoated approximately 16 feet from a net which interrupts a driven ball. After determining the elapsed time of flight of the ball, the attained distance hit is displayed. The present state of the art is highly developed, and it is known to provide a simulated environment of a golf course. Such effects, as the view of the course, ball flight and landing, automatic advance down the fairway in proportion to the ball flight distance, and simulated display change from a fairway to a putting situation within a specified simulated distance from the pin are techniques which are also known.

As a part of the simulated environment, it is usual to provide an optical projection screen located at or immediately behind the ball-intercepting net, a scene display being provided by an optical projector having a series of positive slides or film strips as scene source material. Thus, as the player theoretically approaches the green, new views of the fairway are projected on the screen representing the view seen from the point of the new lay of the ball. Unfortunately, as the play approaches the green, the number of possible angles occurring between the approach lay and the pin increases, so that in the case where the player has not been able to maintain the ball on a reasonably central course, the projected view appears progressively less realistic. Since in the actual playing of golf, it is common to overdrive the pin, a reverse approach is necessary. Once the attained yardage display indicates that the ball has passed the indicated yardage of the tee, it is difficult for the player to visualize exactly where he is in relation to the pin, and the subjective feeling gained by the golfer is not consistent with the scene which is displayed to him, unless provision is made for a slide corresponding to a display from the correct position. The problem is further complicated by the fact that most commercial slide projectors have provision for accommodating magazines capable of holding between 80 and 100 slides with which to cover all of the necessary displays of 18 holes, thereby necessitating accommodation in programming to afford maximum utilization of the available number of slides for as wide a variety of conditions as possible.

BRIEF DESCRIPTION OF THE PRIOR ART

From a structural standpoint, the prior art includes prior U.S. Pat. No. 3,194,562 which discloses a scene shifting calculating means; prior U.S. Pat. No. 3,300,218 which discloses a simple tracking system including a ball image projector; and prior U.S. Pat. No. 3,410,563 which teaches an improved ball image projector in which the size of the image of the ball is diminished automatically to simulate attained distance. A large number of prior art devices include calculating means which take into account such factors as spin imparted to the ball, drift and other deviations related to slicing and hooking on the part of the golfer. In most cases, the additional accuracy obtained does not justify the additional complication of structure.

BRIEF DESCRIPTION OF THE PRESENT INVENTION

Briefly stated, the invention contemplates the provision of an improved computer type golf game offering superior realism when the pin is approached from laterally oriented directions. To this end, there are provided improved controls for the selection of modes of operation, such as actual game, practice and professional settings, play and replay features, automatic and manual putt lights for use when within 10 yards from the pin, a ladies' tee feature and automatic and manual slide change.

Means is provided for introducing fresh data to the computer with the start of each new hole by movement of the film slide magazine, so that the computer may feed information to a display with each successive stroke relative to the distance attained and the remaining yardage. This is accomplished by a coding strip mounted on the slide tray at periodic intervals corresponding to the positioning of a slide showing a display indicating the beginning of a hole in an 18 hole golf course, and indicating the initial distance in yards to the pin. A code readout box is mounted on the slide projector adjacent the magazine to read the coding strip on the slide tray as it moves therepast, preferably by magnetically sensitive means. During play, a three digit display shows the distance in yards attained cumulatively with each stroke, and another three digit display indicates the remaining yardage to the hole. Displays are provided to indicate the overdrive of a ball past the pin, and other displays indicate left or right displacement of a lay with respect to the principal axis of the fairway. Out of bounds lays are separately displayed, and means is incorporated for adding the additional yardage necessary to attain the pin caused by an out of bounds or lateral stroke, when such stroke occurs after the golfer is within a predetermined distance from the pin.

BRIEF DESCRIPTION OF THE DRAWINGS

In the drawings, to which reference will be made in the specification, similar reference characters have been employed to designate corresponding parts throughout the several views.

FIG. 3 including

FIG. 7 including

FIG. 8 is a top plan view of a circular slide magazine with data input means mounted thereon.

FIG. 9 is a sectional view as seen from the plane 9—9 in FIG. 8.

FIG. 10 is a view in elevation as seen from the plane 10—10 in FIG. 8.

FIG. 16 is a chart showing the additional yards correction to be applied to a yards-to-go determination depending upon the degree of lateral displacement of an individual drive from the center of the fairway.

DETAILED DESCRIPTION OF THE DISCLOSED EMBODIMENTS

Figure 1:
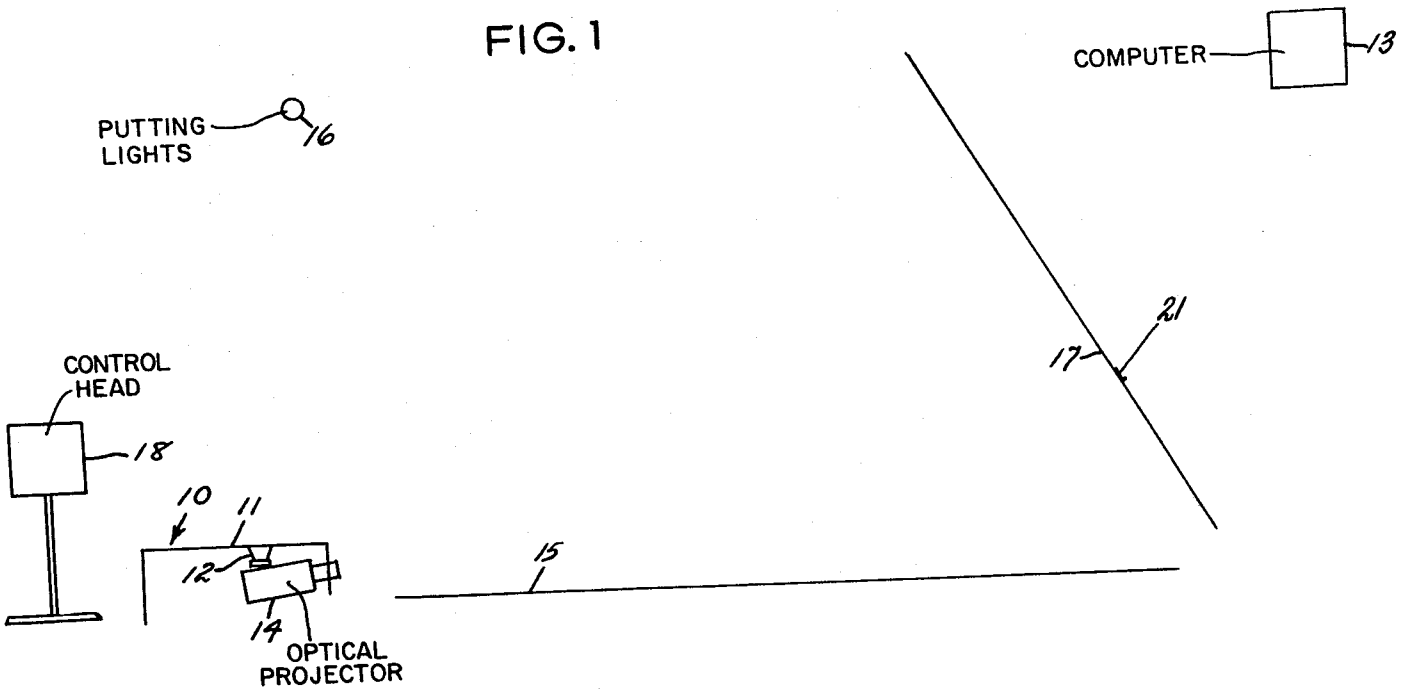
FIG. 1 is a schematic side elevational view of an embodiment of the invention.

Referring to FIG. 1 in the drawings, the device, generally indicated by reference character 10, comprises broadly: a tee location or platform 11 mounting a tee sensor 12, a computer 12 and an optical projector 14. Adjacent to the platform 11 is a putting area 15 selectively illuminated by put lights 16. An angularly disposed screen 17 is positioned approximately 16 feet from the ball tee, and is provided with a plurality of sensors which determine the point of interception of the ball upon the screen.

Figure 2:
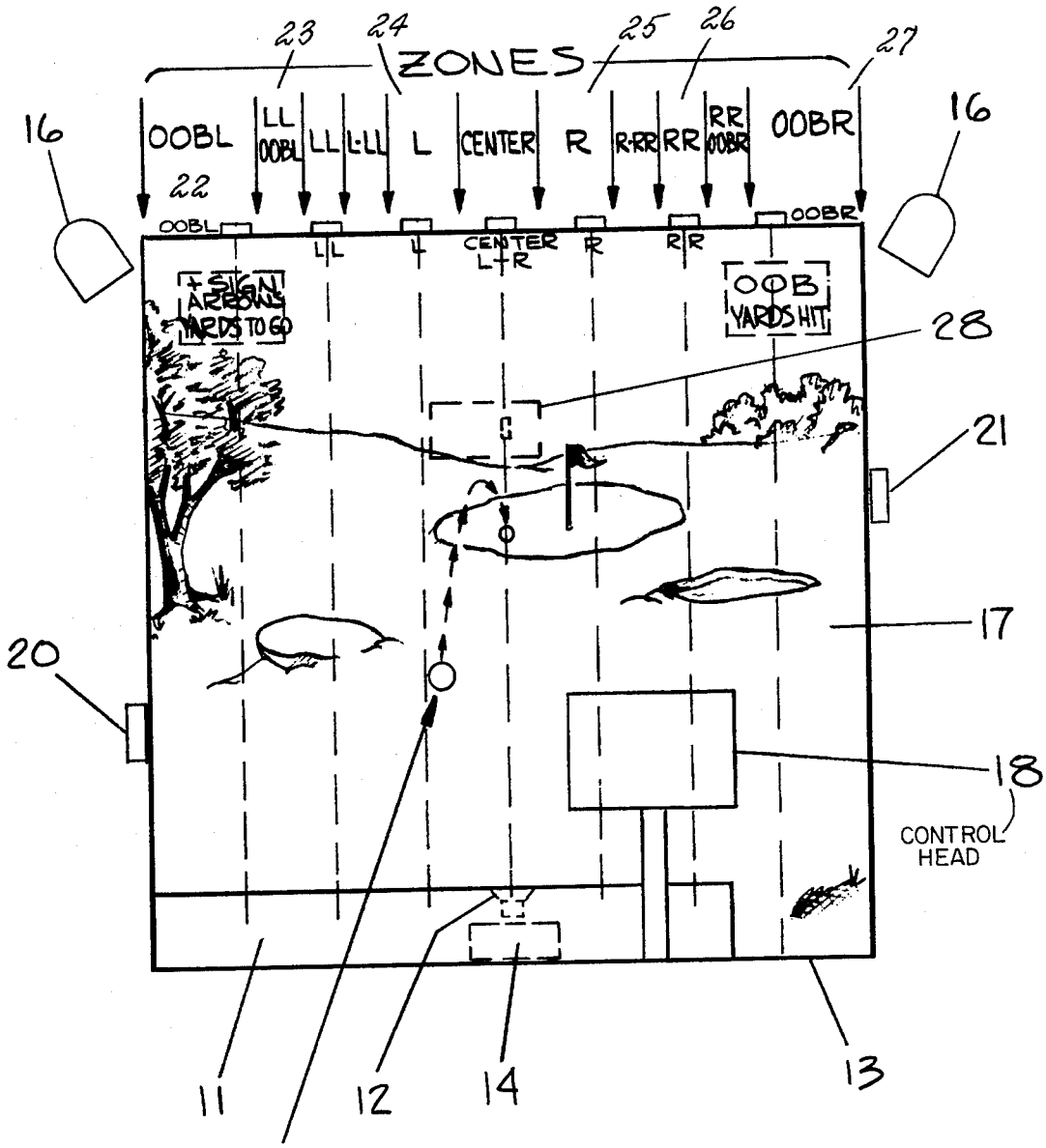
FIG. 2 is a schematic front elevational view thereof.

Mounted adjacent to the platform 11 is a control head 18 for the manual input of desired signals. The head permits manual control of the slide projector, including operational mode selection, play and replay features, put-light control and ladies' tee adjustment, all of which will be detailed hereinafter. As seen in FIG. 2, the net 17 may serve the additional function of a projection screen. When the intercepting screen is of relatively wide mesh, a separate projection screen may be provided. The screen sensors 20 and 21 sense the impact of a ball on the screen 17, and may be of either a vibration or switching type. Behind the screens are means either optical or string-type for sensing the vertical and horizontal location where the ball strikes the screen. Reference characters 23, 24, 25 and 26 define zones within bounds of the displayed scenes. The ball image projector 28 may be of a type similar to that disclosed in U.S. Pat. Nos. 3,300,218 and 3,410,563. The servo mechanism for such ball image projector is controlled by the main electronic system, as disclosed in those patents.

Figure 3A:
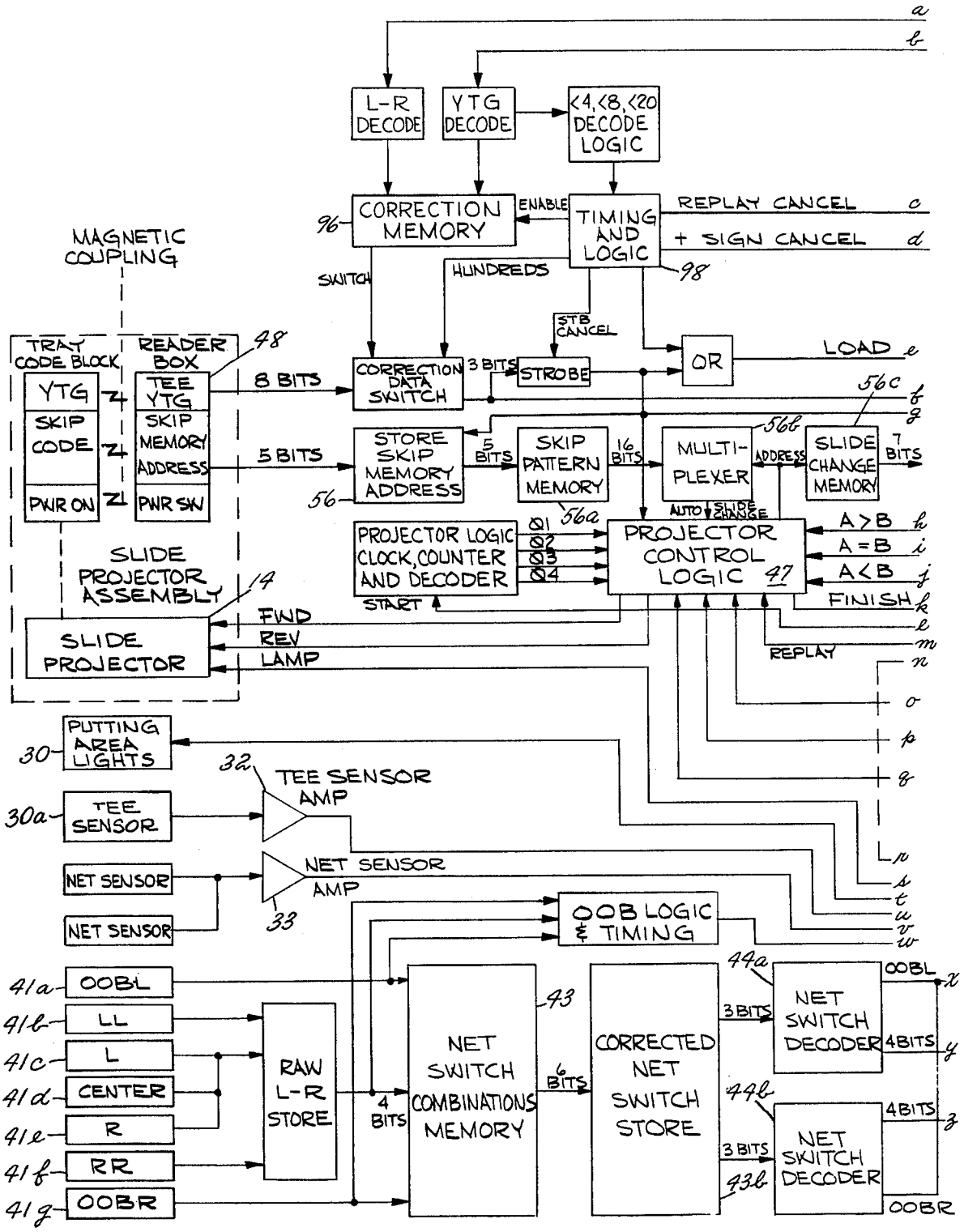
FIGS. 3A, 3B and 3C is a schematic block diagram of certain electronic components comprising the embodiment.
Figure 3B:
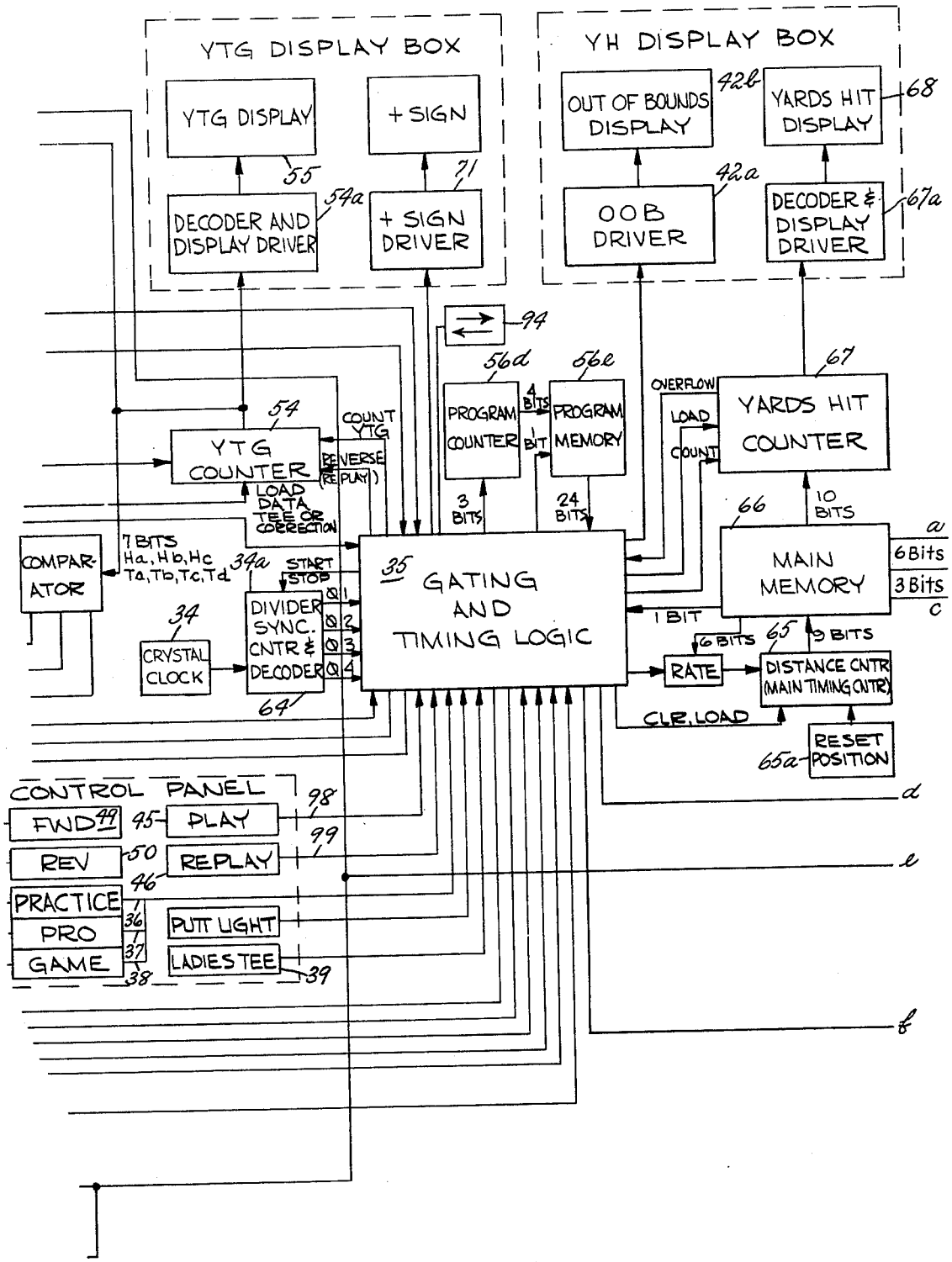
Figure 3C:
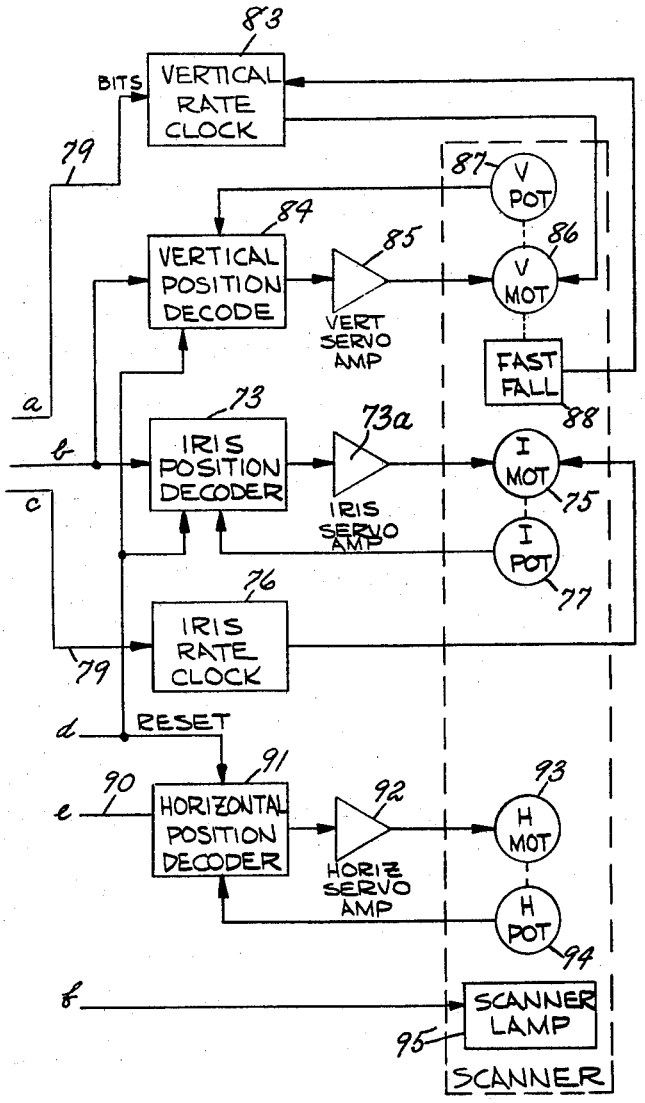

FIG. 3 is a block diagram of the computer 22.

A control panel, located on a control head 18, has a three gang interlocked switch used to select the operating mode. The interlock allows only one mode to be selected at a time. The modes are: Practice, switch 36; Pro, switch 37; and Game, switch 38. A forward switch 49 and a reverse switch 50 provide manual control of the slide projector 14. A putt light switch and its integral indicator manually select and indicate either the operation of the slide projection lamp or putting area lamp. This function is automatically controlled in the Game and Pro modes when the device goes "on green." Special function switches "play" 45, its indicator lamp 96 and replay switch 46 and its indicator lamp 47 are used as desired after their respective indicators illuminate, which show the user that these functions are active. In the Pro mode, the play and replay switches are used to either go ahead in the cycle or repeat the cycle. In the Game mode only, the replay is used to repeat a cycle. There are, of course, special conditions which modify this simplified explanation. A ladies' tee switch 39 and its indicator are used as desired before the first valid hit in the Pro mode or Game mode to decrease the "tee" or starting yardage by 40 yards each time the switch is closed.

Sequencing of the logic is determined by the gating and timing module 35 controlling the program counter 56*d* (FIG. 3B). The program counter addresses the program memory 56*e*, which in turn has 24 single bit control lines that feed back to the gating and timing module 35. Initially, the mode switch selection, combined with a "power on" condition, caused when the power switch 41 supplies alternating current to the power supplies, initiates a "power on" reset circuit which resets the starting conditions of the device. If the mode selected is either Pro 37 or Game 38, the projector control logic 47 will also be enabled. The projector control logic provides automatic control signals to the projector to keep the projected scene in close agreement with the yards-to-go display 55.

The slide projector is a modified conventional type, as for example, that currently available under the trademark "Carousel" and marketed by Eastman Kodak Company, Rochester, N.Y. The modificatons include an active interface installed inside the projector between the "remote" connector and the forward-reverse solenoid, magnetic coded blocks, each representing a golf "tee," fixed to the outside of the slide magazine (FIGS. 8 to 10, inclusive), and a suitable reader box fixedly mounted on the projector for reading the coded blocks.

In the Pro and Game modes, the forward switch 49 or reverse switch 50 is operated so as to align a tray code block 126 with the reader box 48. Then all of the other magnets and blanks are read as two and coded numbers. The first number is a three digit binary number which represents yards-to-go from the tee to the flag on the related particular hole. The second number or skip code represents the number and pattern of slides used for this hole. The three bits representing the hundred digit of the yards-to-go code are read by a strobe circuit and cause a load pulse which jam loads the yards-to-go number into the yards-to-go counter 54. Any number in this counter is decoded from BCD to 7 segments as by decoder/driver 54*a*, and can be displayed by the yards-to-go display 55.

The second number, an encoded slide pattern address or skip code, is stored in the skip code memory address latch 56. This number addresses a skip pattern memory 56*a* which outputs the slide pattern, used for this hole, to a multiplexer 56*b*.

The tee sensor 30*a* pulses as a ball is hit. This pulse, amplified by the tee sensor amplifier 32 signals the gating and timing logic module 34 to start the counting of flight time or distance (yardage).

A crystal oscillator (clock) 34 is divided, synchronized, counted and decoded into four equal phases which appear as four sequential pulses from module 64. The synchronizer assures that each time the clock is restarted, phase 1 will appear first. The gating and timing logic 34 uses the four phases of the crystal clock to divide a program step into four parts. Clock pulses (phase 2) are passed on line 62 to the variable rate divider 63 and then counted into the distance or main timing counter 65. This counter directly addresses the main memory 66. As the distance counter 65 counts, the main memory 66 addresses changes and with each change, the six data lines that feed the variable rate divider 63 change the division ratio. This gives the variable time base necessary to describe the lifting body flight time of the golf ball.

When the ball strikes the screen/net, the net sensors 31A and 31B signal the net sensor amplifier 33 which signals module 34 to stop counting. This stops the distance counter 65 and therefore holds the address to the main memory 66 until the distance counter is later reset. The main memory 66 supplies ten bits of data to the yards hit counter 67 and coded as a three digit BCD number. The decoder and display driver 67A converts the BCD number in the yards hit counter 67 into seven segments at a current level needed to drive the yards hit display 68. The main memory also provides five bits of data to the vertical rate clock 83, six bits to the vertical position decoder 84 and the iris position decoder 73; three bits to the iris rate clock 76 and one bit to the gating and timing logic 34. The vertical position decoder 84 sends a current to the vertical servo amplifier 86 which is related to the final resting position of the ball image. Low yardage hits appear low on the screen and high yardage hits appear high on the screen when the ball comes to rest. The positions are in perspective to match the projected slide image. The vertical servo amplifier, in turn, drives the vertical motor 86. Coupled to the vertical motor 86 is a vertical feedback potentiometer which signals the vertical motor position to the vertical position decoder. This is a standard servo loop. When the vertical motor has reached its final position, the feedback current equals the decoder displacement current and the motor stops turning. The rate at which the vertical motor runs is determined by the vertical rate clock 83 and the fast fall switch 88. The vertical rate is initially set by the five bits which come from the main memory. During the latter part of the ball flight, the fast fall switch is turned on by a cam (not shown). This switch increases the vertical rate of the fall of the ball image increase. This provides a more realistic simulation of a golf ball flight. The iris position decoder 73 sends a current to the iris servo amplifier 73A which is related to the final size of the golf ball image. Low yardage hits appear on the screen as large images, and high yardage hits appear as perspectively related smaller image sizes. Thus, any hit first appears as a large ball image and decreases to a smaller ball image. The iris servo amplifier drives the iris motor 75. The position of the motor 75 is fed back to the iris position decoder 73 by the iris feedback potentiometer 77 in a manner similar to the operation of the vertical motor. The rate at which the iris position, i.e. ball size, changes from its initial size to its final size is determined by the iris rate clock 76. Low yardage drives will change the ball image size quickly, and high yardage drives will change the image size more slowly but with a much greater change.

The horizontal position decoder 91 is controlled by the net switch decoders 44A and 44B. The horizontal position decoder sends a current proportional to the horizontal position to the horizontal servo amplifier 92. The horizontal servo amplifier drives the horizontal motor 93 until the horizontal feedback potentiometer 94 sends a balancing current to the horizontal position decoder.

The vertical, iris and horizontal motors are allowed to run or reset as determined by the gating and timing logic 34. The scanner lamp (not shown) which is the source of the ball image, is turned on and off by the gating and timing logic.

Turning now to FIGS. 8 to 10, inclusive, in the drawing, the means whereby fresh data regarding the total yardage of each new hole is illustrated. Reference character 10 designates a conventional rotary slide magazine, normally integrally molded from synthetic resinous materials to include a lower horizontal wall 111 which rests upon a supporting surface of the slide projector. This wall forms a lower edge rim 112. An inner vertical wall (not shown) engages a slide retaining ring 114. Disposed between the inner vertical wall and an outer vertical wall 115 are a plurality of radially arranged individual septums 116 each forming a pocket 117 retaining individual slides (not shown). The details of the magazine 110 are well known in the slide projector art, and form no part of the present disclosure. Mounted on the outer surface 118 of the vertical wall 115 are a plurality of magnet carrying code units 119 which serially pass the reading unit 48.

The units 119 are also preferably formed as synthetic resinous moldings, and are of generally rectangular configuration. Each is bounded by an inner surface 124 and an outer surface 125. A lower surface 126 rests upon the rim 112. A channel 127 provides means for holding glue (not shown) or an optional dovetail interconnection (not shown) on the magazine, whereby the position of the units 112 with respect to any individual pocket 117 may be adjusted.

Extending between the surfaces 125–126 is a first set of bores 128, 129, 130, 131, 132, 133 and 134. A blank space 135 separates the bores 133 and 134. A second set of bores 136, 137, 138, 139, 140, 141, 142 and 143 is positioned in parallel relation with respect to the first set of bores.

The reading unit 48 includes a shield 144, and mounts Hall effect solid state switches 145, 146, 147, 148, 149, 150 and 151. A space 152 corresponds to the space 135 on each of the code units 119. A second set of switches 153, 154, 155, 156, 157, 158, 159 and 160 corresponds to the second set of bores 136–143, inclusive.

By inserting magnetized pins 162 in specific bores in the code units, it is possible to define a code representative of the total yardage for a given hole. A pin will always be located in the bore 142 which operates the penultimate switch 159 in the second group of switches 153–160, this switch being interconnected with circuitry which prevents any of the remaining switches from operating (in an electrical sense) until the first and second sets of bores in the coding unit are properly aligned with the respective switches in the reading unit 48. Thus, after a signal from the computer incrementally advances the slide magazine to the beginning of a new hole, the data regarding this hole is then read into memory, and with each successive stroke the computer subtracts from this data the attained yardage to determine the yards-to-go figure which is separately displayed.

In addition to feeding data relative to the total yardage of each new hole, data is fed relative to the incremental attained yardage necessary to cause the projector to advance the next slide. From a total of 15 magnetized pins usable for encoding this data, it is possible to obtain 15 separate codes, nine of which are employed to encode total yardage distance for the successive holes, and five of which are employed for encoding incremental distances necessary to advance a slide in the group of slides relating to any one hole.

Thus, most courses will have a shortest hole distance of approximately 150 yards, and a longest hole distance of 600 yards. Nine codes enable the encoding of the entire range in 50 yard increments. The remaining five codes cover the insertion of distances for the advancement of individual slides for increments of 10 to 50 yards.

Figure 13:
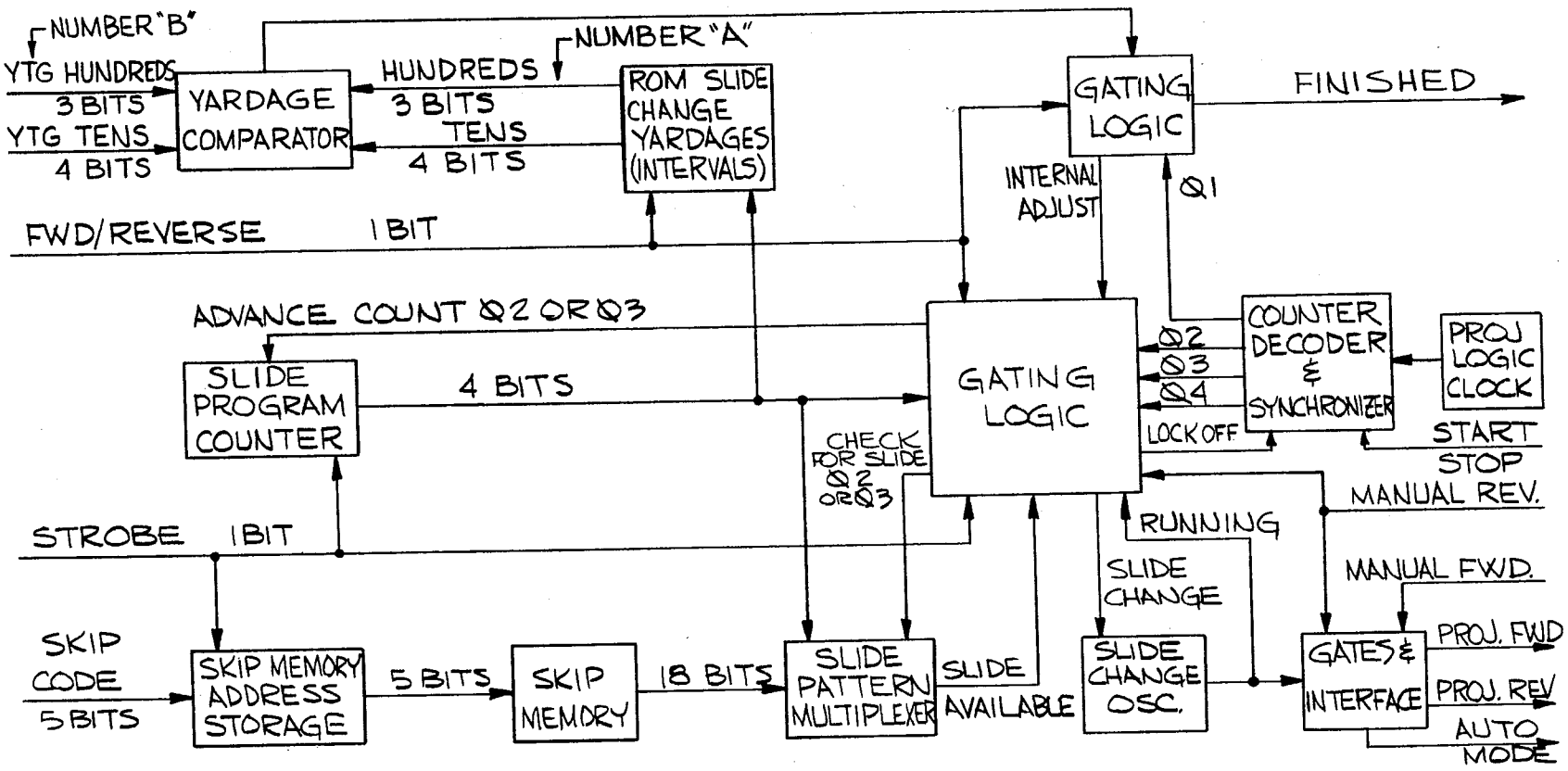
FIG. 13 is a schematic block diagram of a slide projector control element.

Referring to FIG. 13 in the drawings, there is graphically illustrated the means for controlling advance of the slide projector magazine in accordance with attained yardage. Block 165 comprises a series of counters of known type having a yards hit input 166 and a plurality of inputs indicating yards to go for a given hole designated by lines 167, 168, 169, 170, 171, 172, 173. Line 174 designates a common return. The yards to go input operates once with the arrival of the tee slide for each hole. The above mentioned lines 167–1973 represent a combination signal derived from the Hall effect switches on the projector as the tee slide arrives. Lines 167–169 cover three digit values. Adding these lines together, where line 167 represents "one", line 168 represents "two" and line 169 represents "four". Lines 170–173 represent tens of yards, in a similar system, so that it is possible to represent every value in 10 yard increments up to 100 yards. For example, to designate a total yards to go from the tee of 590 yards, use will be made of all of the tee contacts in combination, e.g. 8 and 1 will make 9. Line 173 representing "one" and line 174 represents "two", line 173 represents "four" and line 170 represents "eight".

Reference character 176 denotes a comparator which receives its inputs from block 165 and a read-only-memory, 177 which stores all of the possible programs available for slide advancement for any given hole. The three outputs 178, 179, and 180 indicate whether the value of 165 is greater than the value of the selected program in 177, is equal to it, or less than it.

Along with an enabling signal 180, these outputs are fed to a group of gates indicated by reference character 181 control by a clock 182 through a counter 183 which continuously provides four phases or steps which are output in serial manner continuously. Phase 1 indicated by reference character 184 is a command signal to comparator 176 ordering it to compare counters 165 with the memory 177. Step 2, designated by reference character 185, is a signal to check comparator 187 to determine if there is instantaneously a slide present at a particular advance increment. If there is, a signal progresses to a group of gates 188. Step 3, designated by reference character 186 sends a signal from gates 181 to a connection point 189 between gates 188 and gates 190, whereby the slide projector advance mechanism is activated, and the next slide is moved to position. Depending upon the particular program selected, it is not necessarily the slide next to the previously displayed slide. Depending upon the length of a particular drive, one or more slides may be skipped. Step 4, designated by reference character 191 is a signal serving to stop the clock 182 if no further activity is required. If the instantaneous value of counters 165 is greater than the value of the particular step in the memory program emanating from memory 177, a signal will progress from gates 181 to clock 182 to stop the clock and start the cycle of steps one through four. A line 192 enables this signal.

Reference character 193 designates a group of gates which are controlled manually, overriding computer information to either advance or reverse the slide advance mechanism of the slide projector, as when a replay of a particular hole is desired. The gates 193 have four outputs 194, 195, 196 and 197 which place signals on the interconnection between memory 177 and comparator 187. These four outputs represent numerical values 1, 2, 4 and 8. These four lines permit a maximum of 16 different positions, which are more than adequate considering that the average hole requires no more than 5 or 6 slides.

Skip bits 198, 199, 200, 201 and 202 are obtained from magnetic pin activation of the Hall effect switches on the projector at the tee slide. Here again, a combination of five lines will give 32 possible combinations, depending upon the value of these lines which run 1, 2, 4, 8 and 16. These lines feed a buffer 203 which transmit corresponding signals to a read-only-memory 204. Switches 205 and 206 are relay operated, and are incorporated into the slide projector.

Figure 15:
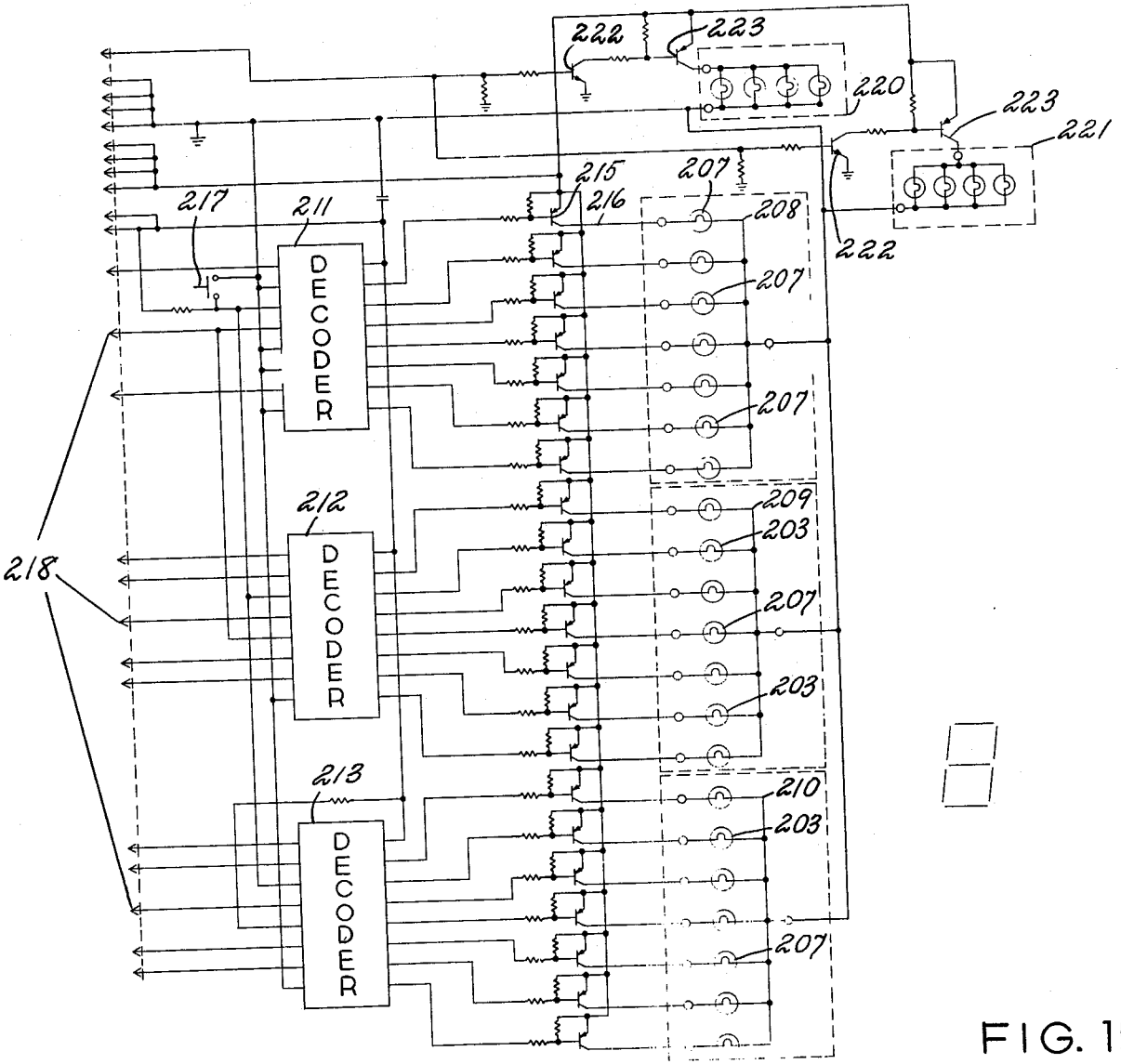
FIG. 15 is a schematic diagram of a mechanical display showing yards hit.

Reference is made to FIG. 15 which illustrates a visual display of well known type. This display is normally located at the net, and because of the required size, incandescent bulbs 207 are employed rather than light-emitting diode devices. The bulbs 207 are separated into three groups 208, 209 and 210 corresponding to hundreds, tens and units. It will be observed that numerical readout is to the nearest yard, although slide advance is determined in multiples of ten yards. Reference characters 211, 212 and 213 designate decoder chips of well known type, the outputs of which control transistors 215 serving as switches to feed lamp current on conductor 216 to the individual bulbs. A manual switch 217 permits the testing of the display by simultaneously illuminating all of the available lamps. Blank lines 218 and 219 serve to inhibit operating of the decoders 211 and 212, respectively, so that a reading of less than ten yards will not be displayed in terms of more than a single digit.

The out of bounds display includes a group of lamps 220 forming a "O", and a second group of lamps 221 forming the "B". Because of the larger currents involved, relatively smaller transistors 222 are used to control larger transistors 223 as relays.

Figure 4:
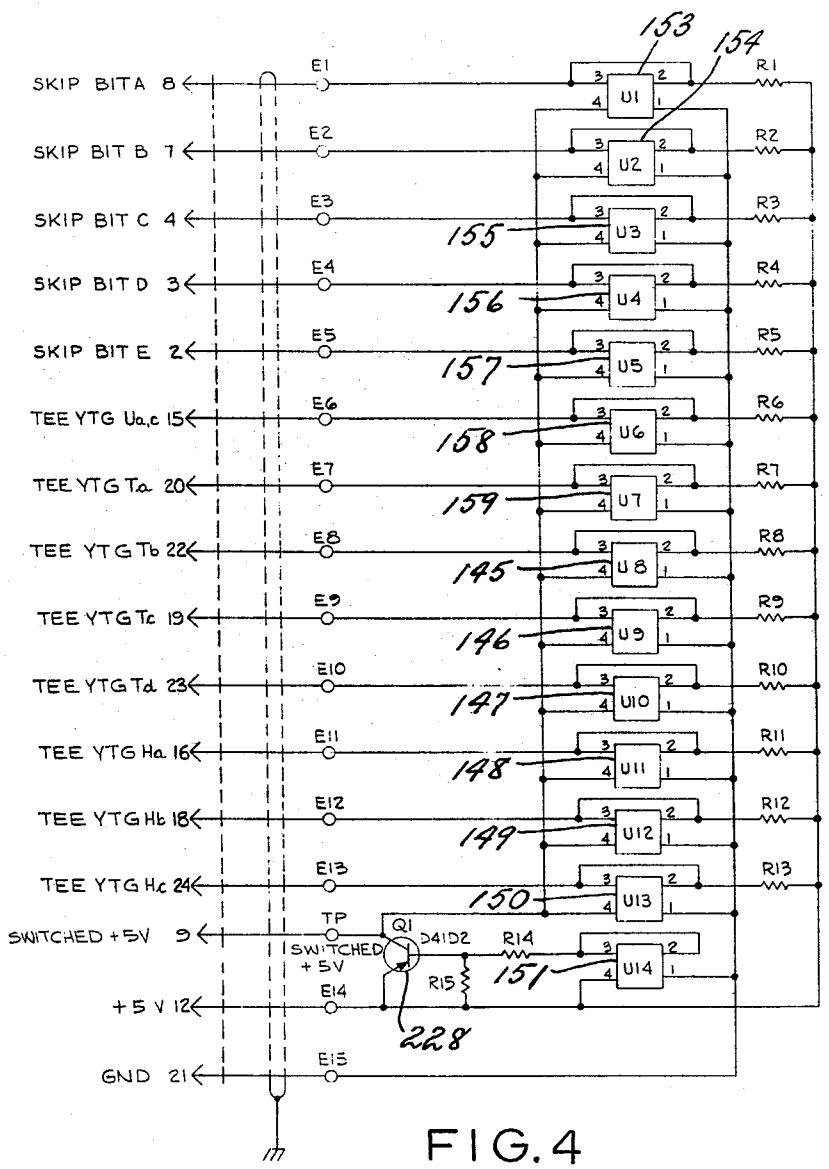
FIG. 4 is a schematic diagram showing the interconnection of circuits between the code reading switches of the slide projector element to the computer.

FIG. 4 illustrates the connections for the Hall effect switches 145–151 and 153–160, all of which are located on the projector to be selectively activated with each successive arrival of a tee slide. Depending upon which of the switches are actuated, signals will be placed on lines 198–202 after actuation of the switch 159. Corresponding signals will be placed on lines E1 through E13, inclusive, thus determining total yards to go for a given hole. As has been mentioned, switch 159 is a safety switch permitting current to flow through switching transistor 228 to make power available for all of the other switches which are activated.

FIG. 16 is a chart showing additional yardage correction to be applied to a remaining yards to go determination of the computer depending upon the degree of lateral displacement of an individual drive. As will more fully appear, where a drive is not straight down the fairway, but in varying degrees either left, right, extreme left, extreme right, or left out of bounds or right out of bounds, certain additional yardages must be taken into account in arriving at a true representation of the remaining yards to go. These values have been computed by simply triangulation, and are automatically determined by the computer at the completion of each stroke. The leftwardmost column entitled "ytg range" indicates remaining yardage. The column designated L, R indicates activation of the corresponding net switches, determining a zone of lateral displacement on either side of the fairway. Assume, for example, that the yards to go indicated is 160 yards, and the last stroke went out of bounds. From memory 204, a determination is made that an additional 37 yards will be required to be added to the remaining yardage to indicate the true remaining yardage from the theoretical lay of the ball.

Figure 5A:
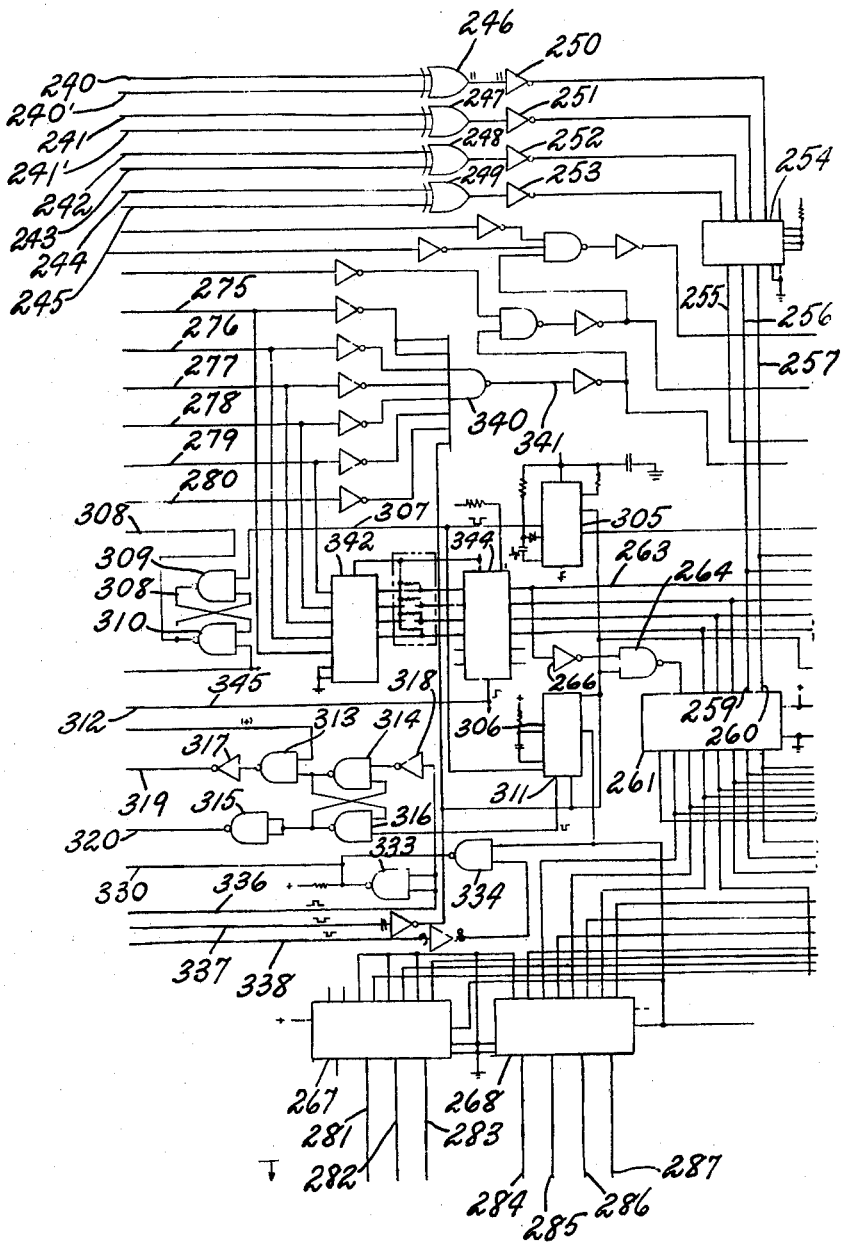
FIGS. 5A and 5B are a schematic diagram showing net correction switch-conditioning circuitry.
Figure 5B:
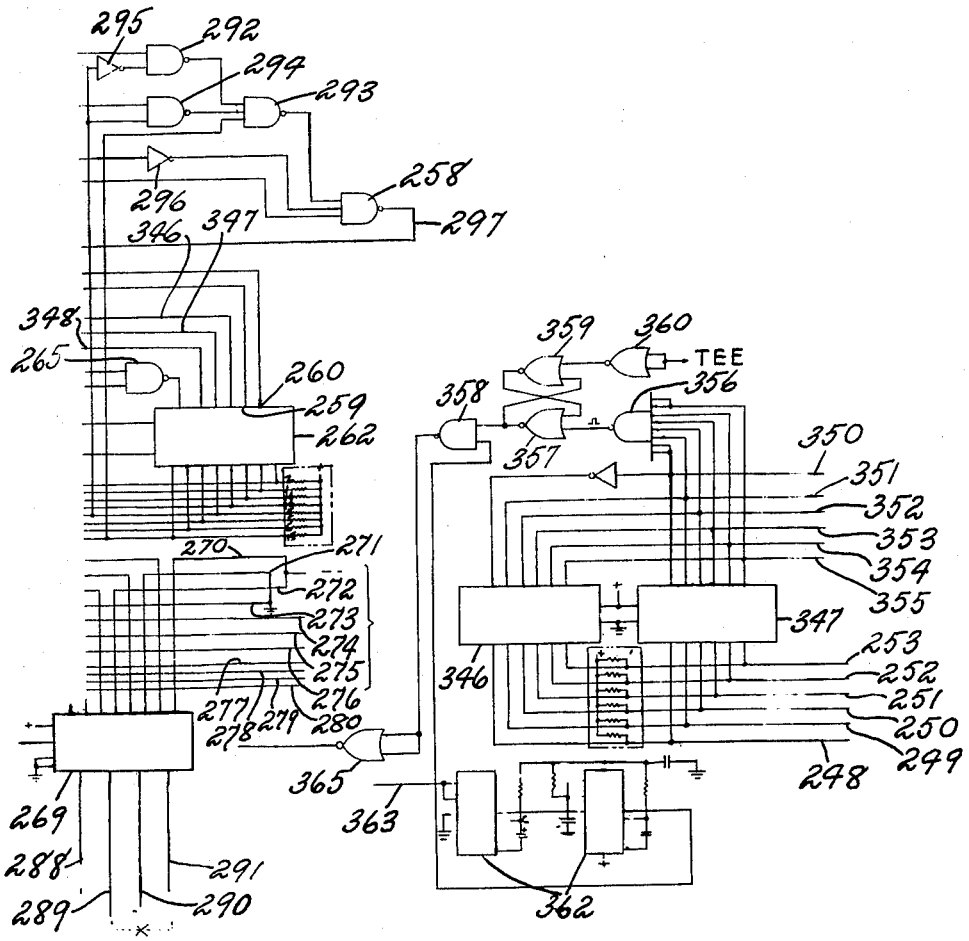

Reference is now made to FIGS. 5*a* and 5*b* which relate to the provision of correction factors to the yards-to-go value displayed at the end of each stroke, net switch conditioning and "no net" switch rejection. Before entering into the structural aspects of these elements, their function should be briefly described.

Where substantially all of the strokes are generally centered with respect to the fairway, the yardage attained with each stroke is simply computed on an elapsed time basis by the computer, and the obtained figure is subtracted from the initial value obtained from the slide tray code on the projector with the arrival of the tee slide in position for projection. For example, if the hole is 300 yards from the tee, a first stroke of 100 yards is simply subtracted, and the yard-to-go figure displayed is 200 yards. Based upon this computation, the slide projector advances a sufficient number of slides to display a view which would be seen by the golfer when he arrives at his lie and ready for the next stroke.

Where a drive is made to the side of the fairway, the succeeding stroke must be made on a diagonal, and obviously the total number of yards which must be driven subsequently is greater than the remaining yardage from the tee to the hole. This yardage must be computed and added to the remaining yards-to-go, so that the sum then determines the actual yards to go to the hole. Once this addition has been performed, the original value of yards-to-go is lost, and circuitry must be provided for inhibiting a replay function, since the projector would be unable to recycle backward to the tee slide without manual override.

There is another factor which remains to be considered in this correction. Since the slide projector will advance its slides based upon attained yardage, if there were no means to add the lateral correction, using the above example, a drive of 290 yards would presumably call for a display of the green in which the hole would be shown as approximately 10 yards away. However, a 290 yard drive to the far left or far right would not place the ball adjacent the green, and where the ball display indicates a far left or far right drive, a display of the green would be unrealistic. It is therefore necessary to add the corrective yardage to the remaining yards-to-go value before a corresponding signal is sent to the projector to prevent such advance until subsequent strokes have been made.

Figure 14:
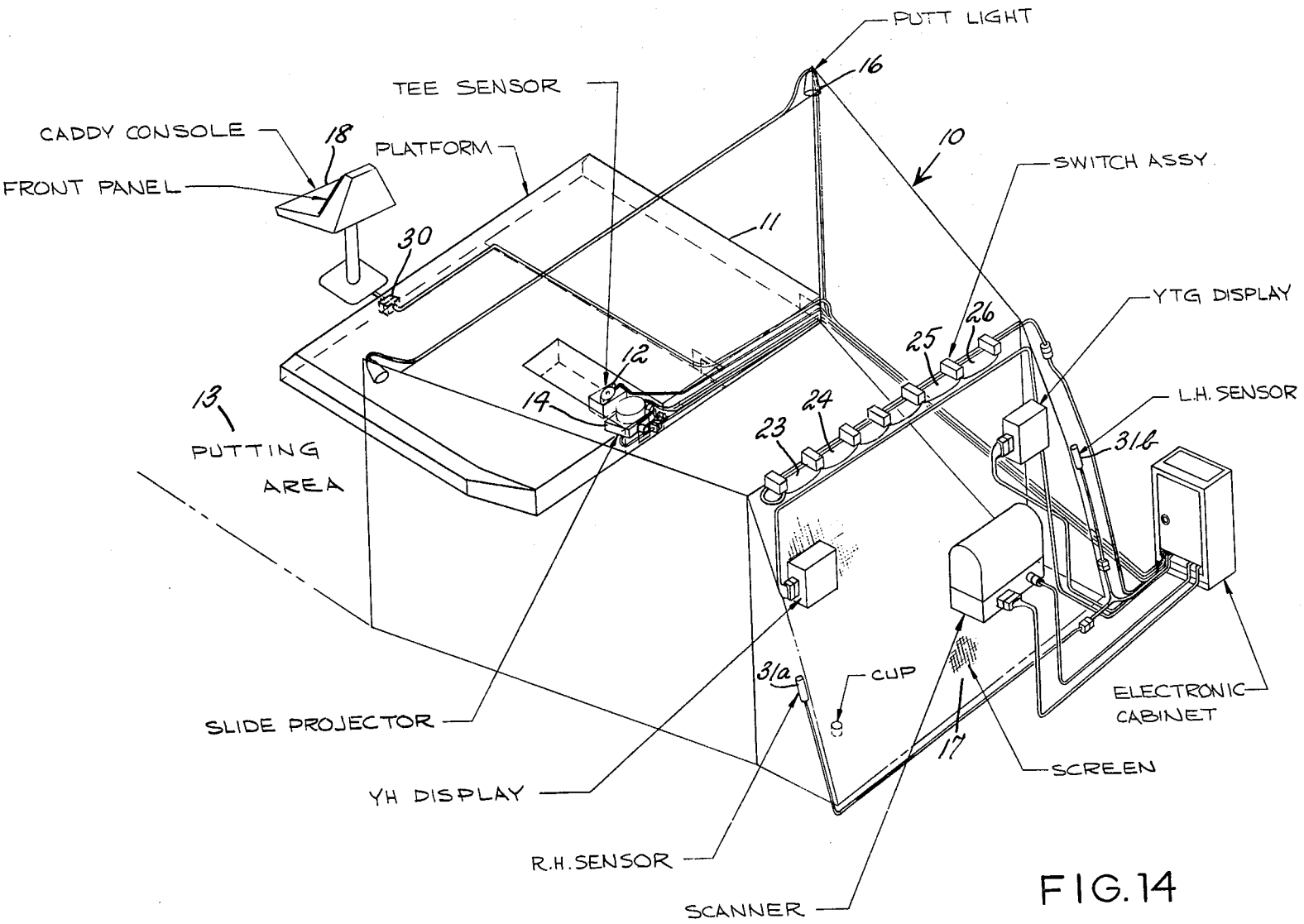
FIG. 14 is a perspective view showing the relative location of the various elements comprising the embodiment.

Net switch conditioning deals with another problem. As best seen in FIG. 14, at the net there are provided right hand and left hand sensors which indicate a contact of a ball with the net. These are actuated either by slight vibration imparted to the net, or by optical sensor means. Very little contact with the net need be made to provide sufficient actuation to the sensors. The switch assembly mounted at the top of the net includes six switches delineating left-right zones on the fairway, and these are actuated, as has been mentioned by sufficient movement in the net to tense strings connected to microswitches. Depending upon the velocity with which the ball strikes the net, and the exact location, varying degrees of distortion will be imparted to the net, resulting in the successive tripping of as many as all of the switches to provide a spurious signal as to exactly where on the net the ball made contact. In the case of a light impact, possibly only a single switch is actuated and the problem of location of the ball is simply determined. Normally, the first two or three switches which are actuated with progressive stretching of the net will give a true indication of the lie of the ball, and means must be provided whereby only those switches which are tripped within a short time period after impact, say 30 milliseconds need be considered, since later tripped switches add nothing in the way of useful information. By utilizing information only from the first few switches tripped, it is possible to simplify the number of possible spurious combinations for which a memory must provide a correct diagnosis.

Yet another situation arises which requires correction. This is the case where the ball has been driven badly out of bounds, and contacts a side wall of the drive range where it expends most of its energy. It rebounds to contact the net, activating one of the sensors, but lacks sufficient impetus to activate one of the net switches. Such a situation must be handled as an out of bounds drive with a display of the out of bounds signal, either left or right. Since no additional yardage along the fairway is attained, the yards-to-go register must be left intact until the next stroke.

Most of the functioning of the circuitry providing the above results takes place at a step in the computer programmer when the horizontal scan of the ball image projector is moving. At this point the ball image projector is not illuminated, and subsecond time intervals are required to shift the ball image projector prior to the start of its display.

Referring to the upper left hand portion of FIG. 5*a*, a plurality of control signals on lines 240, 240', 241, 241', 242, 243, 244 and 245 feed a group of OR gates 246, 247, 248 and 249, in turn feeding, respectively, inverters 250, 215, 252, 253. The outputs of the inverters in turn feed a switching chip 254 having output lines 255, 256 and 257. Output line 254 provides one enabling signal to an AND gate 258. The lines 256 and 257 connect with terminals 259 and 260, respectively, on each of a pair of memories 261 and 262. The memory 261 handles distances of 160 yards and under, while the memory 262 handles distances from 160 to 320 yards, control determination coming from a conductor 262 feeding left and right hand AND gates 264 and 265, respectively. It will be observed that the left hand gate is provided with an inverter 266 whereas the right hand one is not.

The outputs of the memories 261 and 262 connect with switching chips 267, 268 and 269 which also receive inputs from the slide tray code determined by the tee slide, on lines 270, 271, 272, 273, 274, 275, 276, 277, 278, 279 and 280; these lines representing, respectively, yardage of 1, 2, 4, 8, 10, 20, 40, 80, 100, 200 and 400 yards.

Output lines 281, 282, 283 emanate from switch chip 267 representing hundreds. Output lines 284, 285, 286 and 287 emanate from switching chip 268 and represent tens. Output lines 288, 289, 290 and 291 represent units. As will more fully appear, the state of the switching chips 267–269 determines whether the tray code is substituted for the normal input to be fed to the yards-to-go display and computer.

The input lines 240–245 relate to the net switches which are activated, and this will cause a determination as to whether or not a correction factor is involved. The memories 261 and 262 will determine how much correction based upon whether the lay of the ball is within a square area having sides four yards ahead of the hole or past the hole in one case 10 yards ahead of the hole or past the hole in another case, or 20 yards ahead or behind the hole in a third case. It is within these areas that should a ball be driven to the side of the fairway a scene displaying the green will arrive at projection position, thus giving the golfer an impression that he has arrived at the green, when in fact, he knows that he has not. Thus, to simplify the amount of logic required, it is most expeditious to provide no yardage correction factor until the ball has been theoretically driven to within 20 yards of the hole.

When the ball falls within one of these three areas, a network of gates 292, 293, 294 and inverters 295 and 296 provide an enabling signal to gate 258, the output 297 of which permits introduction of corrective factors.

This output is connected to a pair of delay circuits 305 and 306. Circuit 305 feeds an output 307 to an inhibiting circuit 308 including gates 309 and 310, the output of which inhibits operation of the slide projector advance. A terminal 311 on circuit 306 enables an inhibiting circuit 312 comprising four gates 313, 314, 315 and 316; and two inverters 317 and 318, the oup 319 of which prevents illumination of the "plus" display indicating that the hole has been overdriven. The output 330 inhibits the operation of the replay button on the console, so that when the original yards-to-go data is lost through correction, an incorrect replay cycle is prevented. A pair of OR wired AND gates 333 and 334 are controlled by strobe line 336, display trigger line 337 and a load yards hit signal 338 controlled by phase 2 of the clock controlling slide advance in the projector. The output of the OR gate 333–334 is a delay signal to enable tray code information to be substituted by corrective data from the memories.

It will be observed that lines 275 to 280, inclusive, relate to distances greater than 20 yards from the hole, and thus, as explained above, require no correction. The outputs from these lines are fed to AND gate 340, the output 341 providing an enabling signal to AND gate 258. These lines also feed switching chip 342, the outputs of which feed chip 344, the output 345 of which enables horizontal movement of the ball image projector. Other outputs 346, 347, 348 connect with memories 261 and 262 whereby when the yards-to-go corrected data is under 20 yards, the correction factor will be determined by the length of the drive.

The operation of the above described structure will be best appreciated from a consideration of FIG. 16, which is a chart showing corrections which will be supplied by the memories depending upon the length of the attained drive, and the distance from the hole at which the drive was commenced. Lines designated A and B designate the areas of applicable corrections depending upon whether the lay of the ball is in the area within 4 yards of the hole, greater than 4 yards but less than 10 yards from the hole, or greater than ten yards but less than 20 yards from the hole. All designations above line A relate to the closest zone, designations between lines A and B the intermediate zone, and designations below line B the furthermost zone.

As a first example, assume a particular hole to have a total distance of 300 yards, and that the tee shot hits the net in zone LL with an indicated distance of 150 yards. Subtracting 150 from 300 yards gives a remaining yads-to-go of 150 yards. Since the ball is not within the largest zone of less than 20 yards, no correction will be applied at this point. On the next stroke, assume a drive of 125 yards. This yardage is substracted from the remaining yards-to-go of 150 yards indicating that the ball is now 25 yards from the hole. Should the drive be left or right of the center of the fairway, there would still be no applicable correction. Assume the third stroke to result in an additional 10 yard increment, and the first switch to the right of center on the net is contacted. The ball is now in an area 15 yards from the hole, that is to say more than 10 yards and less than 20 yards, and reading rightwardly to the first next column, the applicable additive yardage is 3 yards. The correction circuitry is so arranged that the corrective yardage will be displayed only if it exceeds the remaining yardage to go. In this case, the remaining yardage to go is 5 yards, and the corrected yardage is 3 yards. The corrective factor is therefore not applied.

Assume a replay of the same hole. A first drive of 281 yards indicated lands in the RR zone. Substracting 281 from 300 indicates 19 yards remaining, e.g. within the correction zone of less than 20 yards. Looking rightwardly from the range 280–299 to the RR column, an indicated correction of 51 yards is shown. This is greater than the remaining yardage of 19 yards, and thus the value of 51 yards will be displayed in the yards-to-go display. In each case, the correction figure will be displayed if it is greater than the normal remaining yards-to-go. If not, the remaining yards-to-go figure will be displayed. By using three zones, i.e. less than 4 yards, less than ten yards, and less than 20 yards, it is possible to address the appropriate memories 261 and 262 with greater facility, using a limited field of data. It will be observed that values above the A line are addressed directly when the ball lies less than 4 yards from the hole, and no value in this zone is above 9 yards. Similarly, the zone between lines A and B cover the range between 11 and 20 yards, and the zone below line B values from 20 to 68 yards. Since the concomitant object of this plan is to prevent the appearance of a slide in the projector showing the green when the player is not adjacent the green, and since the average width of the displayed green represents approximately 25 yards, it is not necessary to have further zones above 20 yards from the hole.

The net conditioning circuitry is illustrated in the lower right hand portion of FIG. **5*b*. Six lines 350, 351, 352, 353, 354 and 355 supply raw net switch input information for processing. These lines are connected to memories 346 and 347 which store a corrected output for every possible raw input. The corresponding outputs from the memories are indicated by reference characters 248, 249, 250, 251, 252 and 253. It is the outputs of these lines which are fed to the lines 240–246 which are intended to carry corrected data. The lines 350–355 also input to an AND gate 356 which outputs to an OR gate 357 outputting to an AND gate 358 and an OR gate 359 receiving the output of OR gate 360**, the input of which comes from a signal generated when the golf ball is struck at a tee.

Reference character 362 designates a timing circuit of known type, operated by an input 363 from a step in the computer program which activates the horizontal motor of the golf ball image projector, the output serving as one of the inputs in AND gate 358. The time period is in the order of 30 milliseconds, which constitutes the reading period for the net switches. By confining the reading of the net switches to this time interval, normally not more than three net switches will be read, the final switch usually being a spurious signal. Gate 358 outputs to an OR gate 365. Thus, operation of this circuitry is activated by the driving of the golf ball which starts the computer program. Where net switches have been activated, raw data is processed into corrected data and fed to the circuitry above described. Assume a poor stroke in which the tee microphone is activated, but the ball hooks or slices to a side wall of the range where it richochets after expending most of its kinetic energy to a point where it contacts the net, but with velocity insufficient to activate any of the net switches. The sensors will indicate contact of the ball. After the lapse of the above mentioned 30 millisecond time interval, gate 348 is enabled, and the signal through gate 365 results in illuminating the out of bounds display (left or right direction being immaterial).

OVERALL OPERATION

To afford greatest flexibility in the use of the device, normally it may be used for both practice with complete manual operation or semi-automatic operation. Where a game is to be played by one or more players, the operation is substantially automatic, except where manual override is necessary to permit the same hole to be played successively by several players. The following outline indicates the general operation in incremental steps roughly paralleling the computer program.

1 Three basic modes of machine operation are defined, they are:
1.1 Drive mode, manual operation.
1.2 Pro mode, semi-automatic control.
1.3 Game mode, automatic control.
2.0 Assume Power On Drive mode manually selected.
2.1 Turn putt lights off. Select scene view slide by forward or reverse push buttons.
2.2 Tee up, hit ball.
2.3.1 Assume lie in bounds, net sensor activates in less than 1 second.
Ball image projector on and moves
Ball stops
Yards hit display on
Two to four second delay
Yards hit display off
Ball display off
2.3.2 Assume out of bounds
Out of bounds display on
Two to four second delay
Out of bounds display off
2.3.3 Assume ball does not hit screen within 1 second.
2.4 No action
Return to step 2.2.
3.0 Power on. Assume pro mode selected.
3.1 Turn putt lights off, slide projector turns on. Advance or reverse projector to any tee slide in the sequence with the forward or reverse buttons.
3.2 Tee up, hit ball
Yards to go display on
Two to four second delay
Yards to go display off
3.3 Assume in bounds, screen sensors hit in less than 1 second.
Ball image projector on and moves.
Ball stops
Yards hit display on
Yards to go display on (= previous yards to go − last yards hit)
Play and Replay buttons light/active.
3.3.1 Press Play Button
Replay light and Play light turn off.
Ball simulator, off, resets
Yards hit, off
Projector advances as called for
Two to four second delay
Yards to go display off
3.3.2 Press Replay Button
Replay light and Play light turn off
Ball simulator off, resets
Yards hit display off
Yards to go display reads distance of previous shot.
Two to four second delay
Yards to go display off
3.4 Return to step 3.2
3.5 Assume out of bounds lay. Sensor only (left or right).
Out of Bounds light on
Two to four second delay
Out of bounds light off.
3.6 Return to step 3.2.
3.7 Assume ball does not activate net sensor in under 1 second.
No action. Return to step 3.2
3.8 Assume advance to near green slide, 20 yards.
3.9 Advance to within 10 yards of pin, on center.
Ball simulator turns on, moves and stops.
Yards hit and yards to go display on.
Play and Replay buttons turn on.
3.10.1 Press Play Button
Ball simulator off, resets
Play and Replay lights off
Projector advances to 10 yard slide
Two to four second delay
Projector off
Putt out light on
Yards to go display off
Yards hit display off
3.10.2 Press forward button.
Advance to next tee slide in sequence.
3.10.3 Press Reverse button.
Projector increments in reverse to tee
Slide of same hole
Projector on (at Tee)
Putt out light off
Note: Press Reverse button from any slide except last slide, only one reverse slide change will implement.
3.10.4 Press Replay Button
Ball simulator turns off and resets.
Yards hit display off
Play and Replay buttons turn off
Yards to go display reads yards of previous shot
Yards to go display off
3.11 Assume advance from 100 yards or more to within 10 yards of pin, but to the left or right.
Ball simulator turn on moves and stops
Yards to go display on
Yards hit display on (corrected value)
Arrow left or right is on
Play and Replay buttons light turn on
3.12.1 Press Replay button
As in Paragraph 3.10.4 except arrows display.
3.12.2 Press Play Button
As in Paragraph 3.10.1 except arrows on/off follows yards to go display sequence 3.13 Assume drive over pin more than 10 yards, center
Ball simulator turns on, moves and stops
Yards hit display on
Yards to go display on
Plus sign on
Play and Replay buttons light turn on
3.13.1 Press Play button
Action as in Paragraph 3.10.1 except plus sign follows yards to go display sequence.
3.13.2 Press Replay Button
Action as in Paragraph 3.10.4 except plus sign off
Note: Plus sign remains on for over drive balls. Arrows left or right turn off after any valid shot on center.
4.0 Press game mode button — automatic control.
4.1 Game mode control is selected, power on.
4.2 Manually advance or reverse projector to any tee slide in the sequence with the forward or reverse buttons.
Yards to go display on, displays yards to hole
Two to four second delay
Yards to go display off
4.3 Reduce 40 yards increments from yards-to-go by ladies T push button if necessary. Yards-to-go display on after each reduction.
4.4 Tee up, hit ball
4.5 Assume lay in bounds, net sensor hit in less than 1 second.
Ball simulator on, ball travels in the correct direction and stops
Yards hit display on
Yards to go display on (yards to go — yards hit)
Two to four second delay
Ball simulator off (resets)
Yards hit display off
Projector advances if called for
Two to four second delay
Yards to go display off
Replay light on
4.5.1 Press Replay Button
Replay light turns off
Yards to go display will show the distance as prior to the last shot
Projector will reverse slides if called for
Two to four second delay
Yards to go display off
4.6 Assume lay out of bounds
Out of bounds light on
Two to four second delay
Out of bounds light off
Replay button inhibited
4.7 Assume lay on green within 10 yards of hole.
Ball simulator turns or moves and stops
Yards hit display on
Yards to go display on (yards to go — yards hit)
Two to four second delay
Ball simulator turns off and resets
Yards hit display off
Projector advances to on green slide
Two to four second delay
Yards to go display off
Projector off
Putt lights on
4.8 On green over hole within 10 yards.
Action same as 4.7 except,
Yards to go reads true distance from hole
Plus sign on, follows yards to go display sequence.
4.9 On green within ten yards of hole over or under, but left or right.
Action as 4.7 and 4.8 except with left or right arrows indication.
Correct yards-to-go information inserted, of applicable.
4.10.1 Press advance button
Projector will advance to next Tee slide
Action as in paragraph 4.2 except:
Projector on (at Tee)
Putt out lights off
4.10.2 Press Reverse button.
When on green slide, projector will return to previous Tee Slide.
4.11 Tee up, hit ball.
4.12 Assume lay passed the pin by more than 10 yards and left or right.
Ball simulator turns on, moves and stops
Yards hit display on
Yards to go display on, shows reverse distance from pin
Plus sign on
Arrow left or right on
Two to four second delay
Yards hit display off
Yards to go display off
Plus sign off
Arrow off
Note: 1. Manual advance to any Tee slide will insert new tray code data and begin a new sequence.

Figure 6:
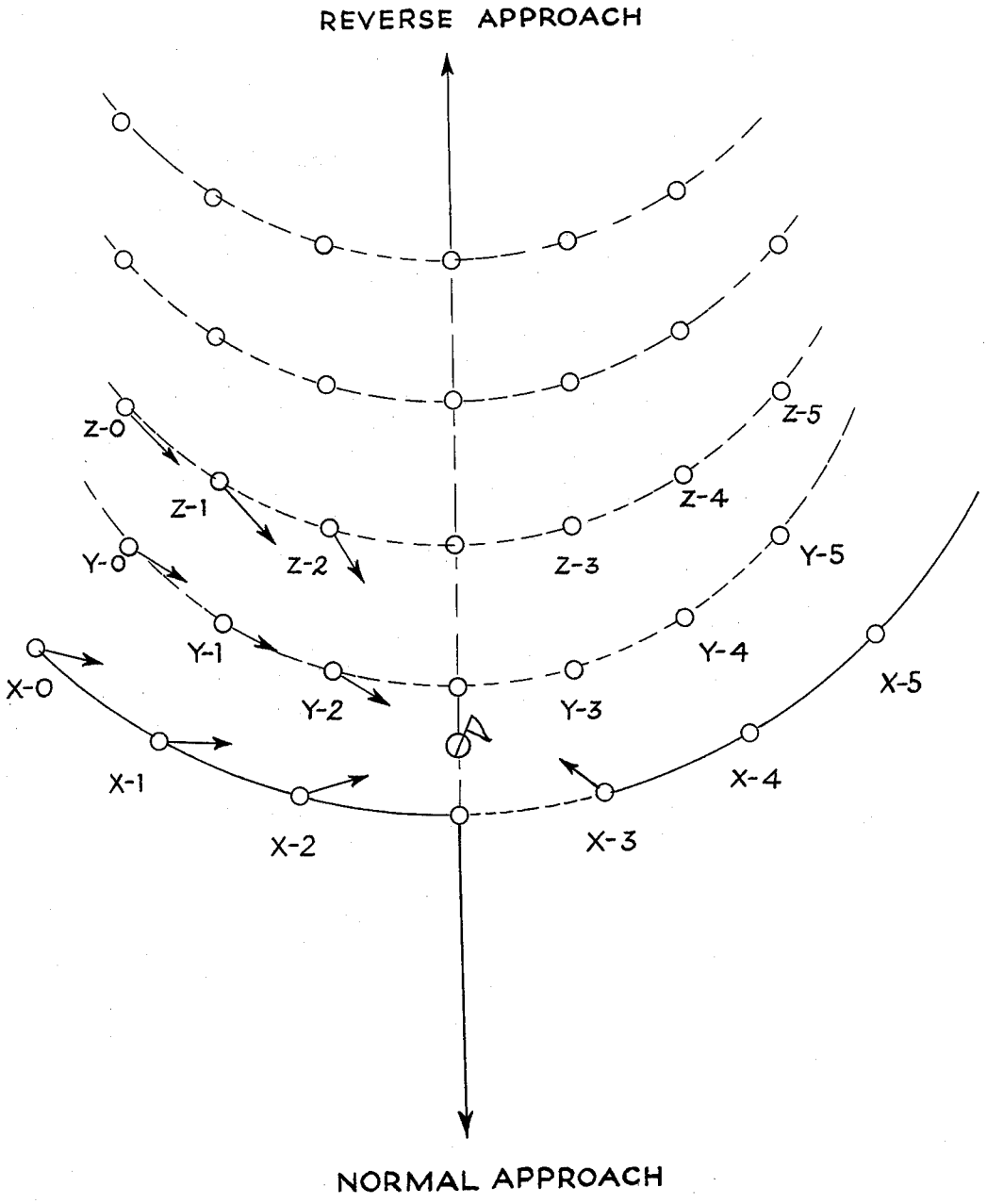
FIG. 6 is a schematic diagram showing a polar coordinate system employed in the selection of suitable views of the pin.

FIG. 6 illustrates the polar coordinate system employed for the selection of the proper slide when play has reached 10 to 20 yards of the pin. The total area is selected to range from 10 to 20 yards of the distance to the pin, and a series of circular loci of increasing distances of one yard are plotted. At intervals of approximately 12½°, points are established at X0, X1, X2, etc. from which photographs have been taken facing the pin. The selection of the proper image is determined by information from the yards attained register, and the particular screen sensors which have been activated by the impact of a ball on the screen.

Figure 7A:
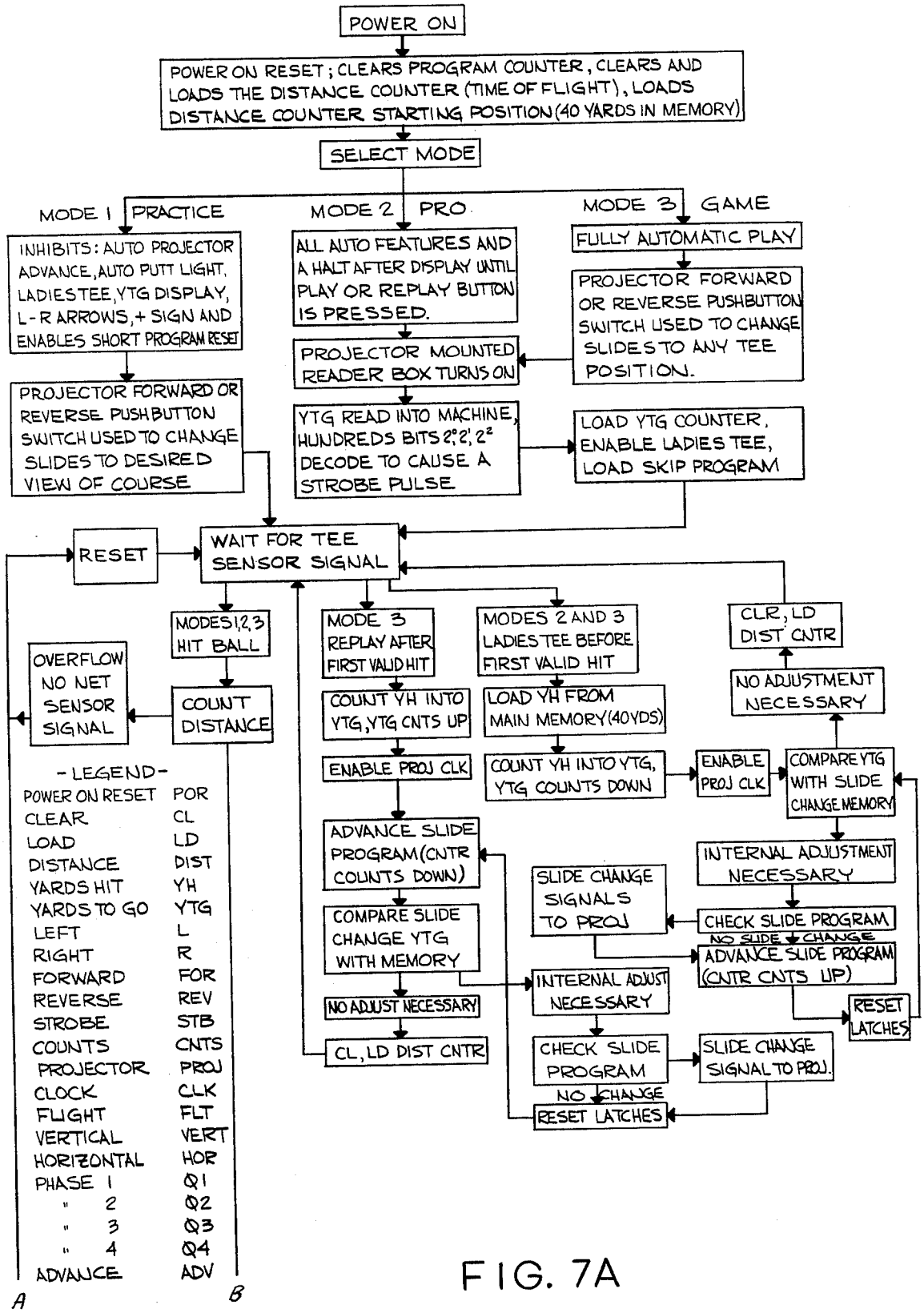
FIGS. 7A and 7B is a schematic diagram showing the logic sequence during operation.
Figure 7B:
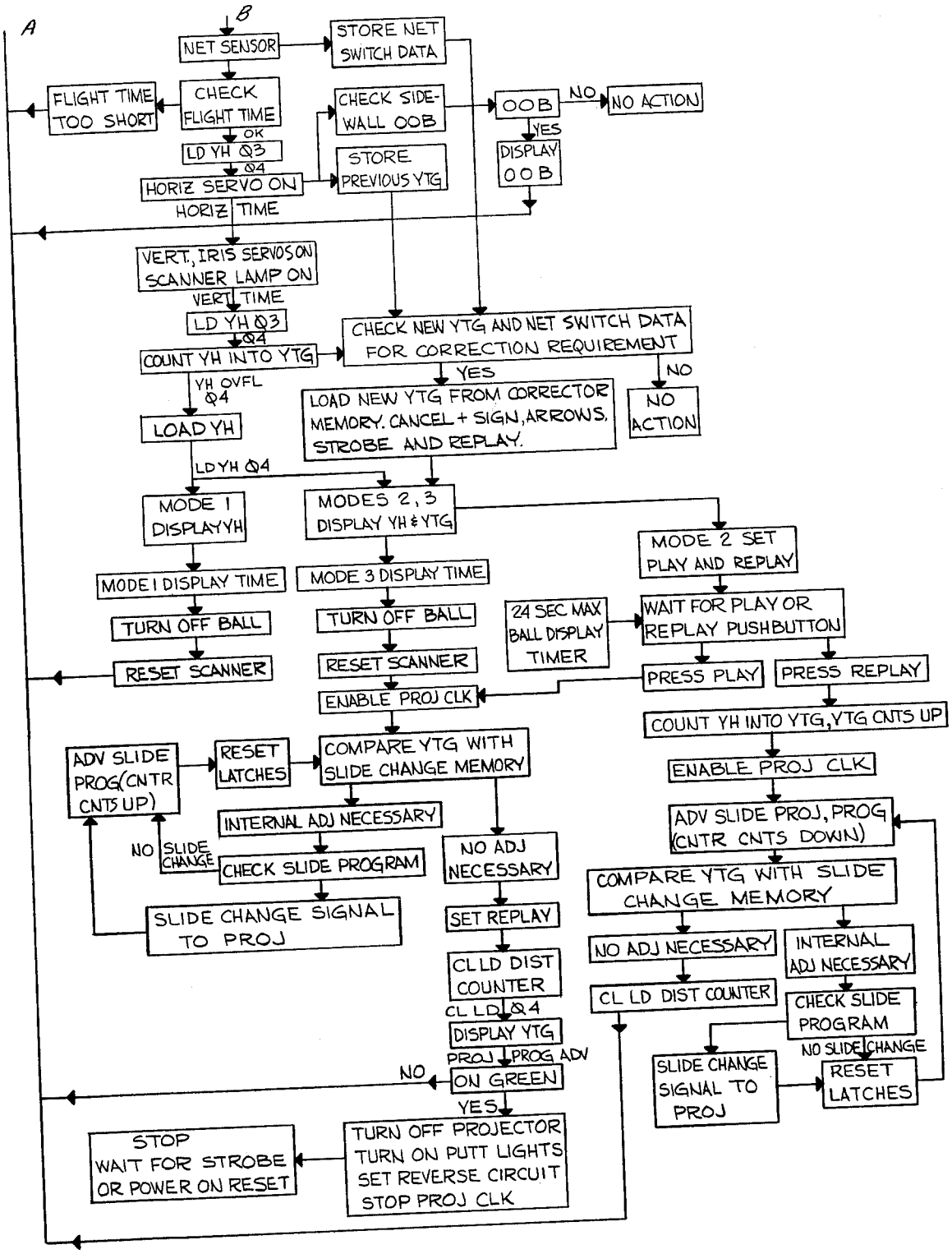
Figure 11:
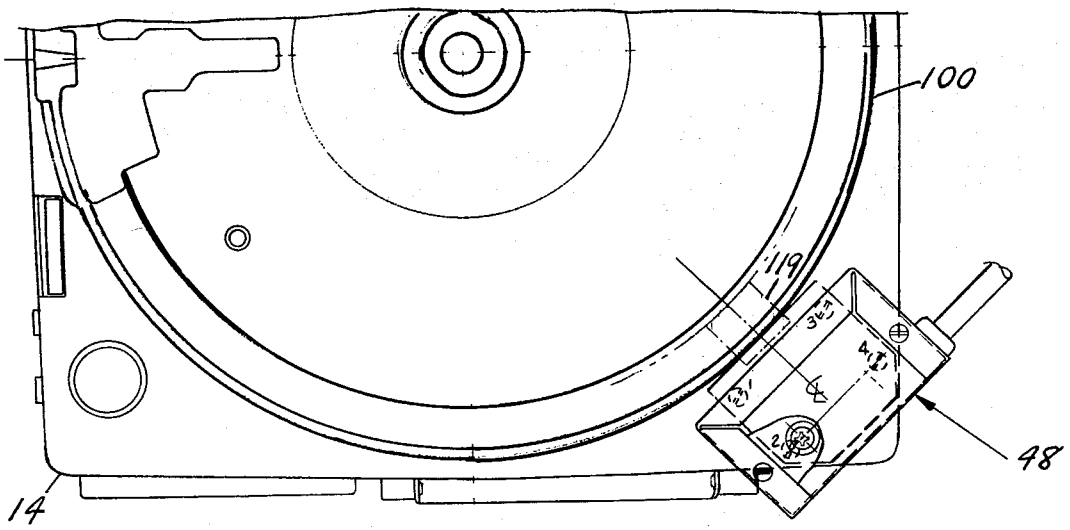
FIG. 11 is a fragmentary top plan view of a slide projector element forming a part of the embodiment.
Figure 12:
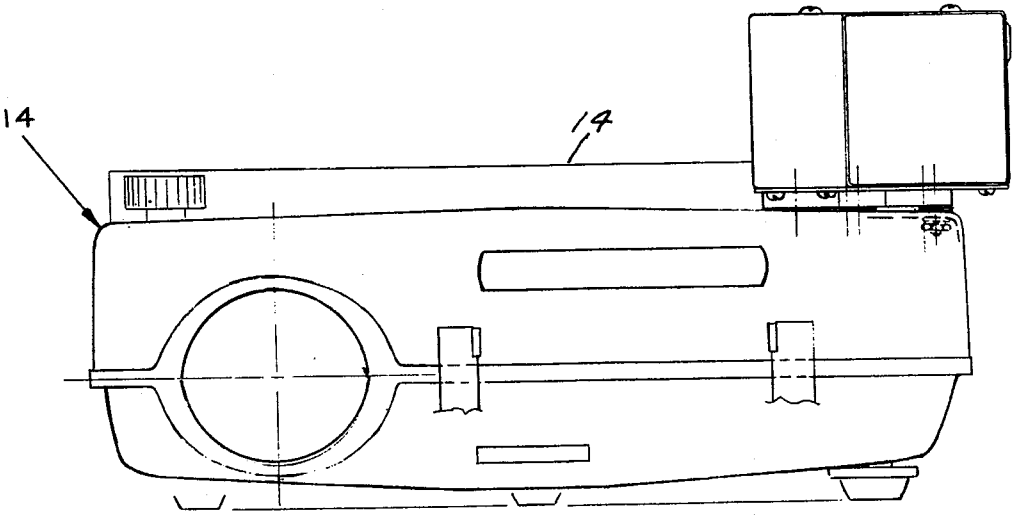
FIG. 12 is a front elevational view of the slide projector element.

FIG. 7 illustrates the logic sequence followed in the above described operation. In the present state of the art, the result is achieved by providing several projectors, each of which carries approximately 100 slides.

We wish it to be understood that we do not consider the invention limited to the precise details of structure shown and set forth in this specification, for obvious modifications will occur to those skilled in the art to which the invention pertains.

We claim:

1. In a computer-type golf game including sensing means for determining the time of flight of a ball between a tee off point and a point on a screen, and computer means for determining the theoretical flight distance of said ball based upon elapsed time, means for projecting a series of images of a golf course under control of said computer means, and a simulated ball image projector under control of said computer, for casting a ball image in superimposed relation upon said screen, the improvement comprising: means sensing the point of impact of said ball with respect to the central axis of said screen, said projector having image storage means for selectively projecting images corresponding to views facing a pin on a golf green corresponding to predetermined points at varying coordinate distances from said pin, said images being successively selected for projection for a subsequent stroke on the basis of distances attained, and the degree of lateral displacement of an immediately preceding stroke, first signal means for indicating the presence of a stroke overshooting the pin of a hole, and second signal means indicating degrees of lateral displacement of a lay of the ball on either side of the fairway; whereby a single set of generally centrally oriented projected images may be employed for the successive display of view for each hole.

2. Structure in accordance with claim 1 in which said image projecting means comprises an optical slide projector having a series of slides incrementally advanced under control of said computer.

3. Structure in accordance with claim 2, in which said slide projector includes a slide magazine sequentially storing a series of slides representing attained progress for each hole, the first slide for each hole having coding means associated therewith, a relatively fixed code reading means connected to said computer, and disposed adjacent said magazine to be responsive to each successive coding means as the same is positioned in proximity thereto; whereby upon the commencement of each successive hole with the advancement of the first slide relating to said hole to projecting positions, new data relative to the total yardage of said new hole is inserted in said computer to permit the computer to determine the distance remaining to said hole after each successive stroke.

4. Structure in accordance with claim 3, including means for inserting corrective distance data to said computer for altering said basis of distances attained.

* * * * *